US007614404B2

(12) United States Patent
Kee

(10) Patent No.: US 7,614,404 B2
(45) Date of Patent: Nov. 10, 2009

(54) CASE WITH SPRING-LOADED MASCARA BRUSH

(76) Inventor: Jung-Hyun Kee, Pumywang Apratment 104-702, 81-59, Gajwa-Dong, Seo-Gu, Incheon 404-250 (KR)

( * ) Notice: Subject to any disclaimer, the term of this patent is extended or adjusted under 35 U.S.C. 154(b) by 372 days.

(21) Appl. No.: 10/563,048

(22) PCT Filed: Apr. 30, 2004

(86) PCT No.: PCT/KR2004/001011

§ 371 (c)(1),
(2), (4) Date: May 1, 2007

(87) PCT Pub. No.: WO2005/002389

PCT Pub. Date: Jan. 13, 2005

(65) Prior Publication Data

US 2007/0204872 A1 Sep. 6, 2007

(30) Foreign Application Priority Data

Jul. 1, 2003 (KR) ..... 20-2003-0021017 U

(51) Int. Cl.
*A45D 40/26* (2006.01)

(52) U.S. Cl. ..... 132/218

(58) Field of Classification Search ..... 132/218, 132/317, 318, 320; 401/126, 128, 129, 130; 15/184

See application file for complete search history.

(56) References Cited

U.S. PATENT DOCUMENTS 5,116,154 A * 5/1992 Fulkerson ..... 401/127
7,429,141 B2 * 9/2008 Habatjou ..... 401/127

* cited by examiner

*Primary Examiner*—Robyn Doan
*Assistant Examiner*—Rachel R Steitz
(74) *Attorney, Agent, or Firm*—IPLA P.A.; James E. Bame

(57) ABSTRACT

The object of this invention is to provide a mascara case having a case body and a cap. The case with a spring-loaded mascara brush, is constructed so that a brush stem (43) coupled to the cap moves downward by a predetermined length when the cap is separated from the case body (10) to open the case body, thus allowing a user to easily use a small amount of mascara remaining in a bottom of the case body without the necessity of completely closing the cap, and the brush stem coupled to the cap moves upward when the cap is put on the case body to close the case body, thus preventing a brush from touching the bottom of the case body.

2 Claims, 5 Drawing Sheets

CASE WITH SPRING-LOADED MASCARA BRUSH

TECHNICAL FIELD

The present invention relates, in general, to a mascara case having a case body and a cap and, more particularly, to a case with a spring-loaded mascara brush, which is constructed so that a brush stem coupled to a cap moves downward by a predetermined length when the cap is separated from a case body to open the case body, thus allowing a user to easily use a small amount of mascara remaining in a bottom of the case body without the necessity of completely closing the cap, and the brush stem coupled to the cap moves upward when the cap is put on the case body to close the case body, thus preventing the brush from touching the bottom of the case body.

BACKGROUND ART

Generally, mascara is a cosmetic used to arrange or straighten eyelashes, thus making a user look better. The mascara is produced by mixing charcoal with oil. Further, the mascara is typically classified into cream mascara, cake mascara, and liquid mascara, according to a form thereof. Among the mascaras, the liquid mascara has been most widely used.

A mascara case functions to contain mascara so that a user can easily use the mascara. As shown in FIG. 1, a conventional mascara case includes a case body 1, an outer cap 4, a brush unit 7, and a brush 8. The case body 1 contains a predetermined amount of mascara therein. A neck 3 of a predetermined height is provided at an upper end of the case body 1, with an external threaded part 2 provided on the neck 3. The outer cap 4 defines a predetermined space therein, and covers an upper portion of the case body 1. The brush unit 7 is fastened to the outer cap 4 through a force-fit method. An internal threaded part 5 is provided on a predetermined portion of the brush unit 7 to correspond to the external threaded part 2 of the neck 3. A brush stem 6 is integrally provided at a lower portion of the brush unit 7 to extend to a predetermined length, thus being inserted into the case body 1. The brush 8 is coupled to a lower end of the brush stem 6.

In such a mascara case, when the outer cap is completely closed, the brush 8 coupled to the lower end of the brush stem 6 is placed to be adjacent to a bottom of the case body 1.

However, the conventional mascara case has a problem in that, when the amount of mascara remaining in the case body 1 is very small, a lower end of the brush 8 does not reach the mascara, so that it is inconvenient to use the mascara.

In a detailed description, when a user desires to make up the user's eyelashes using the mascara contained in the case body 1, the outer cap 4 is separated from the case body 1, and then the mascara covered on the brush 8 is applied to the user's eyelashes. Thus, when the amount of mascara remaining in the case body 1 is very small, in order to dip the brush 8 in the mascara, the outer cap 4 must be completely closed so that the external threaded part 2 of the neck 3 completely engages with the internal threaded part 5 of the outer cap 4 through a screw-type fastening method. Thereby, it is inconvenient to use the mascara.

In other words, as shown in FIG. 1, when the neck 3 of the case body 1 is completely covered with the outer cap, the brush 8 is placed to be adjacent to the bottom of the case body 1, so that it is possible to use a residual amount of mascara. However, when the outer cap is separated from the case body 1, the brush 8 is spaced apart from the bottom of the case body 1 by a distance "d2" corresponding to a neck's height "d1", so that a user cannot use the residual amount of mascara.

As a result, when the height of mascara remaining in the case body 1 is lower than the distance d2, the outer cap 4 must be completely coupled to the case body 1 through the screw-type fastening method whenever a user dips the brush 8 in the mascara, so that it is very inconvenient to use the mascara.

Further, the conventional mascara case is problematic in that the opening of the neck 3 is equal to or thicker than the brush 8, so that the mascara may undesirably flow out from or leak out the neck 3 when the brush 8 or the brush stem 6 is covered with an excessive amount of mascara.

DISCLOSURE OF THE INVENTION

Accordingly, the present invention has been made keeping in mind the above problems occurring in the prior art, and an object of the present invention is to provide a case with a spring-loaded mascara brush, which is constructed so that a brush stem is provided along a central axis of a cap which opens or closes a case body, in such a way as to move vertically. Therefore, when the cap is opened, the brush stem moves downward by a predetermined distance, thus allowing a user to easily use a small amount of mascara remaining in a bottom of the case body without the necessity of closing the cap. Further, when the cap is coupled to the case body to close the case body, the brush stem coupled to the cap moves upward, thus preventing the brush from touching the bottom of the case body.

Another object of the present invention is to provide a case with a spring-loaded mascara brush, which has a scraping unit coupled to an inner circumferential surface of a neck of a case body to extend downward; thus scraping off surplus mascara covered on a brush or brush stem, therefore preventing the loss of mascara.

In order to accomplish the above object, the present invention provides case with a spring-loaded mascara brush, including a case body to contain a predetermined amount of mascara therein, with a neck being provided at an upper end of the case body and having an external threaded part, an outer cap to cover an upper portion of the case body, a brush unit provided in the outer cap, with a brush stem integrally provided at a lower portion of the brush unit to extend to a predetermined length, and a brush coupled to a lower end of the brush stem. The case further includes an inner cap having a shape of a hollow cylinder which is opened at top and bottom ends thereof, and fastened to an interior of the outer cap through a force-fit method. The inner cap includes an internal threaded part provided on an inner circumferential surface of a lower portion of the inner cap to correspond to the external threaded part of the neck, and an annular step integrally projecting from the inner circumferential surface of the inner cap at a position above the internal threaded part. The brush unit is inserted into the inner cap to move vertically by a predetermined distance, and includes an annular locking step provided at a predetermined position on an outer circumferential surface of the brush unit to be stopped by the annular step of the inner cap, a spring seat provided on an upper surface of the annular locking step to be depressed, and the brush stem integrally provided at the lower portion of the brush unit to extend to the predetermined length, thus being inserted into the case body. The case further includes a spring supported, at both ends thereof, by the spring seat and an inner surface of the outer cap, thus elastically biasing the brush unit during a vertical movement of the brush unit, and thereby, moving the brush stem in a vertical direction.

The case further includes a scraping unit coupled to the neck of the case body, and having a shape of a hollow cylinder which is opened at top and bottom ends thereof. The scraping unit includes a locking ring provided around an outer circumference of an upper end of the scraping unit, and a protrusion provided around an inner circumference of a lower end of the scraping unit to scrape off surplus mascara covered on the brush.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
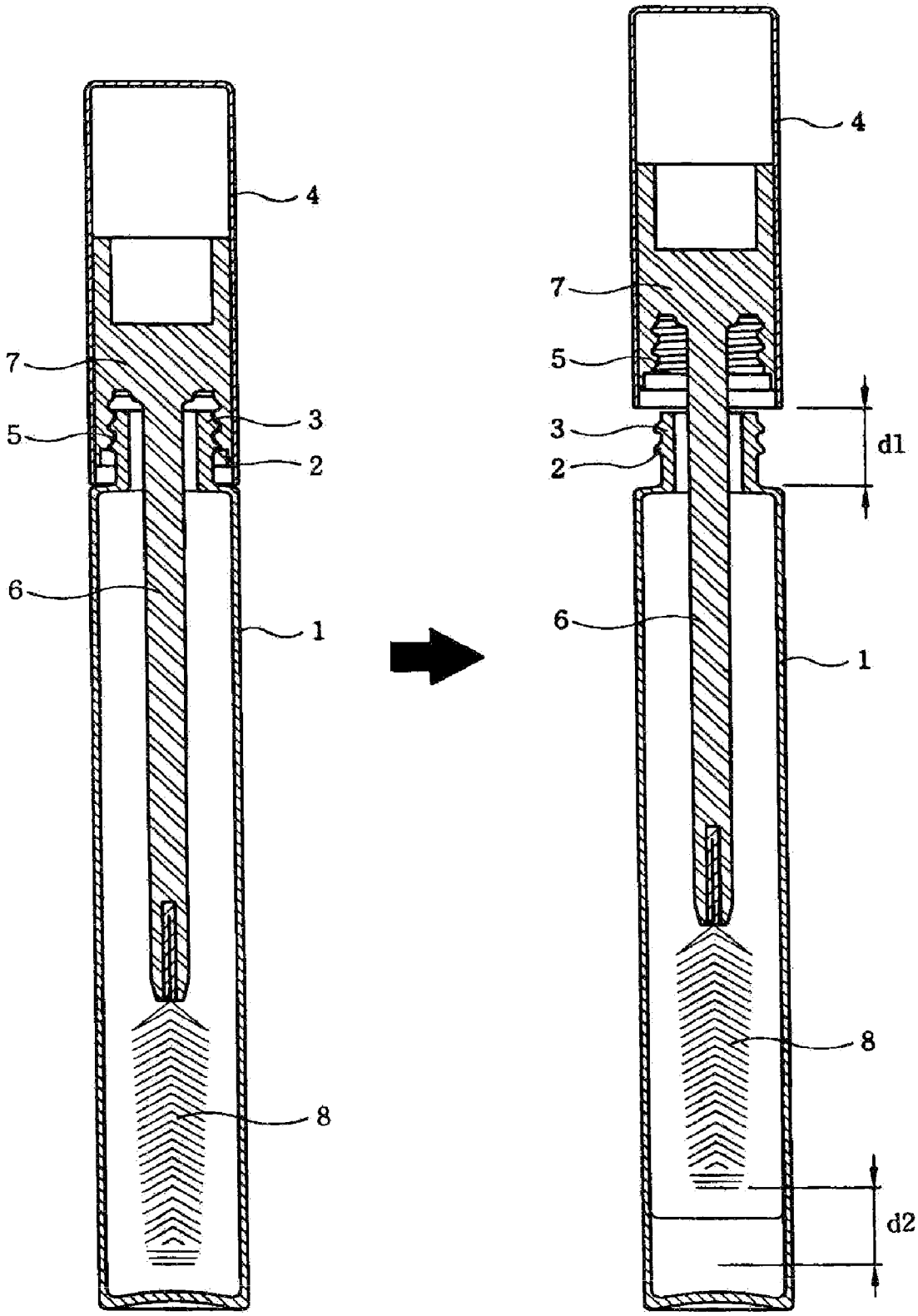
FIG. 1 Prior Art
FIG. 1 is a side sectional view of a conventional mascara case.

Reference should now be made to the drawings, in which the same reference numerals are used throughout the different drawings to designate the same or similar components.

Figure 2:
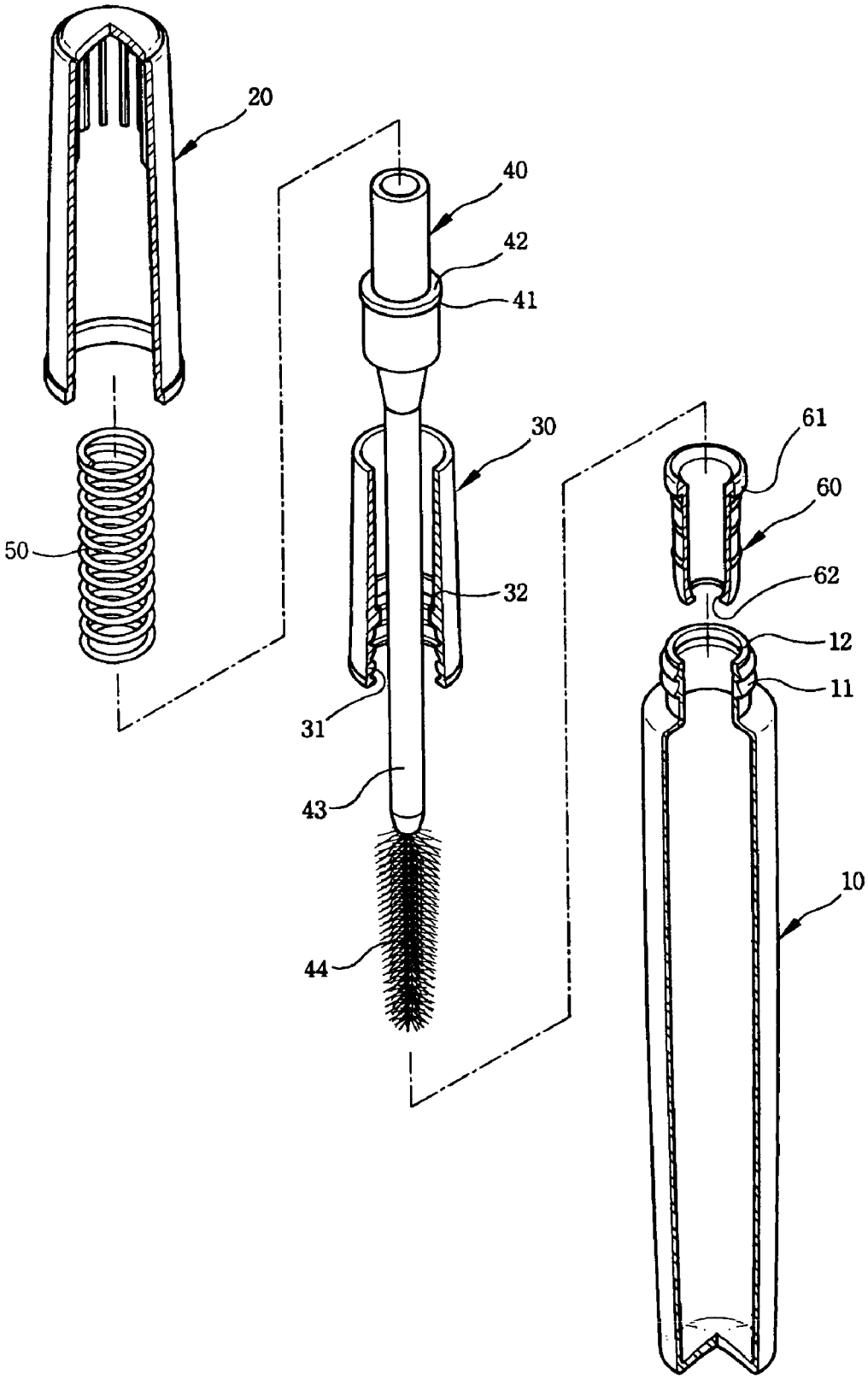
FIG. 2 is an exploded perspective view of a case with a spring-loaded mascara brush, according to the present invention.
Figure 3:
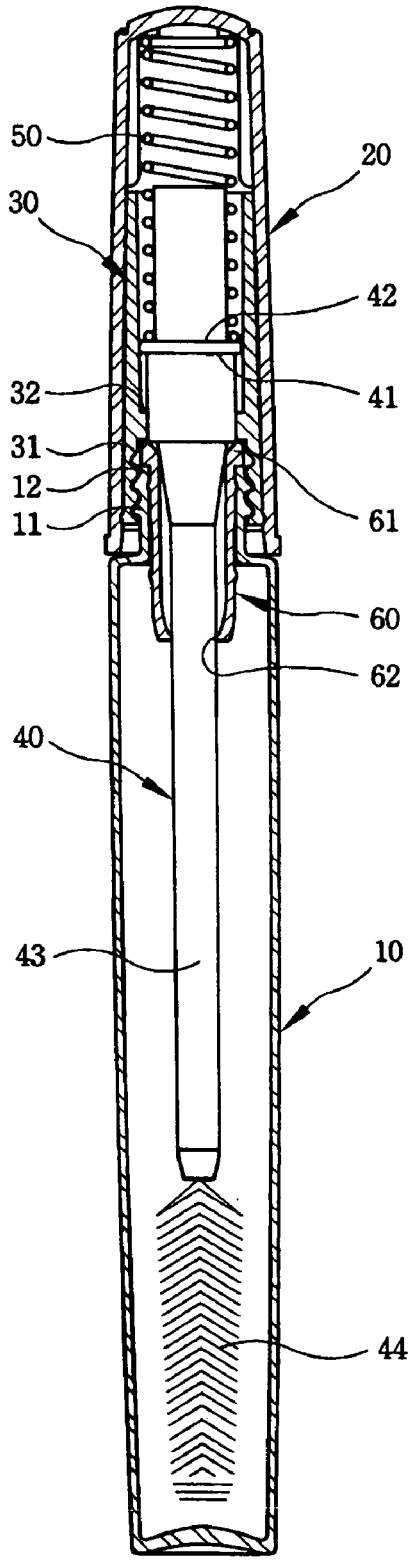
FIG. 3 is a side sectional view of the case with the spring-loaded mascara brush, according to the present invention.

FIG. 2 is an exploded perspective view of a case with a spring-loaded mascara brush, according to the present invention, and FIG. 3 is a side sectional view of the case with the spring-loaded mascara brush, according to the present invention.

As shown in FIG. 2 or 3, the case with the spring-loaded mascara brush according to the present invention includes a case body 10 and a cap. The cap includes a conventional outer cap 20. Further, important parts of this invention, that is, an inner cap 30, a brush unit 40, and a spring 50 are provided in the outer cap 20.

In this case, the case body 10 is manufactured through an injection molding process using metal or synthetic resin, and has a shape of a barrel capable of containing a predetermined amount of mascara therein. A neck 12 of a predetermined height is provided at an upper end of the case body 10, and has an external threaded part 11.

The outer cap 20 covers an upper portion of the case body 10, and defines a space therein so that the brush unit 40 moves vertically by a predetermined distance. The inner cap 30, the brush unit 40, and the spring 50 are provided in the outer cap 20. Further, ribs are provided on an upper portion of an inner circumferential surface of the outer cap 20, thus preventing the inner cap 30 from moving beyond a predetermined extent when the inner cap 30 is fastened to the outer cap 20 through a force-fit method.

The inner cap 30 has a shape of a hollow cylinder which is opened at top and bottom ends thereof and has a predetermined length, and is fastened to the outer cap 20 through the force-fit method. Further, an annular groove is formed on a lower portion of the inner circumferential surface of the outer cap 20, while an annular projection is provided on a lower portion of an outer circumferential surface of the inner cap 30, so that the annular projection of the inner cap 30 is coupled to the annular groove of the outer cap 20 through a snap locking method, thus preventing the inner cap 30 from being undesirably removed from the outer cap 20.

Further, an internal threaded part 31 is provided on a lower portion of an inner circumferential surface of the inner cap 30 to correspond to the external threaded part 11 of the neck 12. An annular step 32 is integrally provided at a position above the internal threaded part 31 to project from the inner circumferential surface of the inner cap 30. In this case, the annular step 32 is positioned under a center of the inner cap 30, thus ensuring a space for the vertical movement of the brush unit 40.

The brush unit 40 is inserted into the inner cap 30 to move vertically while the moving distance of the brush unit 40 is limited by the annular step 32. An annular locking step 41 is provided at a predetermined portion on an outer circumferential surface of the brush unit 40 to be stopped by the annular step 32. A spring seat 42 is integrally provided on an upper surface of the locking step 41 to support an end of the spring 50. In this case, the spring seat 42 is inwardly depressed to allow the spring 50 to be stably seated in the spring seat 42.

Further, a brush stem 43 is integrally provided at a lower portion of the brush unit 40 to extend to a predetermined length, while being inserted into the case body 10. A brush 44 is coupled to a lower end of the brush stem 43 in such a way that a lower end of the brush 44 is close to a bottom of the case body 1.

The spring 50 is supported, at both ends thereof, by the spring seat 42 of the brush unit 40 and an inner surface of a top wall of the outer cap 20, thus elastically biasing the brush unit 40 during the vertical movement of the brush unit 40, and thereby, moving the brush unit 40 in a vertical direction. Preferably, the spring 50 may comprise a coil spring.

Further, a scraping unit 60 is coupled to the neck 12 of the case body 10, and has a shape of a hollow cylinder which is opened at top and bottom ends thereof. A locking ring 61 is provided around an outer circumference of an upper end of the scraping unit 60. A protrusion 62 is provided around an inner circumference of a lower end of the scraping unit 60. In this case, the locking ring 61 is stopped by an upper end of the neck 12 to prevent the scraping unit 60 from being retracted into the case body 10. The protrusion 62 scrapes off surplus mascara covered on the brush 44 or the brush stem 43.

The scraping unit 60 is gently inwardly curved at a lower portion thereof, and is relatively sharply projected at a lower end of the lower portion, thus forming the protrusion 62 to scrape off surplus mascara covered on the brush 44 or the brush stem 43.

In this case, the coupling between the neck 12 of the case body 10 and the scraping unit 60 is carried out in a similar manner to the coupling between the outer cap 20 and the inner cap 30. Annular grooves are provided on an inner circumferential surface of the neck 12 of the case body 10, while annular projections are provided on an outer circumferential surface of the scraping unit 60 to correspond to the annular grooves of the neck 12, so that the scraping unit 60 is coupled to the neck 12 through the snap locking method. Another annular projection is provided on a predetermined portion of the scraping unit 60 to be placed just under the neck 12, thus preventing the scraping unit 60 from being easily removed from the neck 12.

The operation and operational effects of the mascara case according to the present invention will be described in the following in detail.

Figure 4:
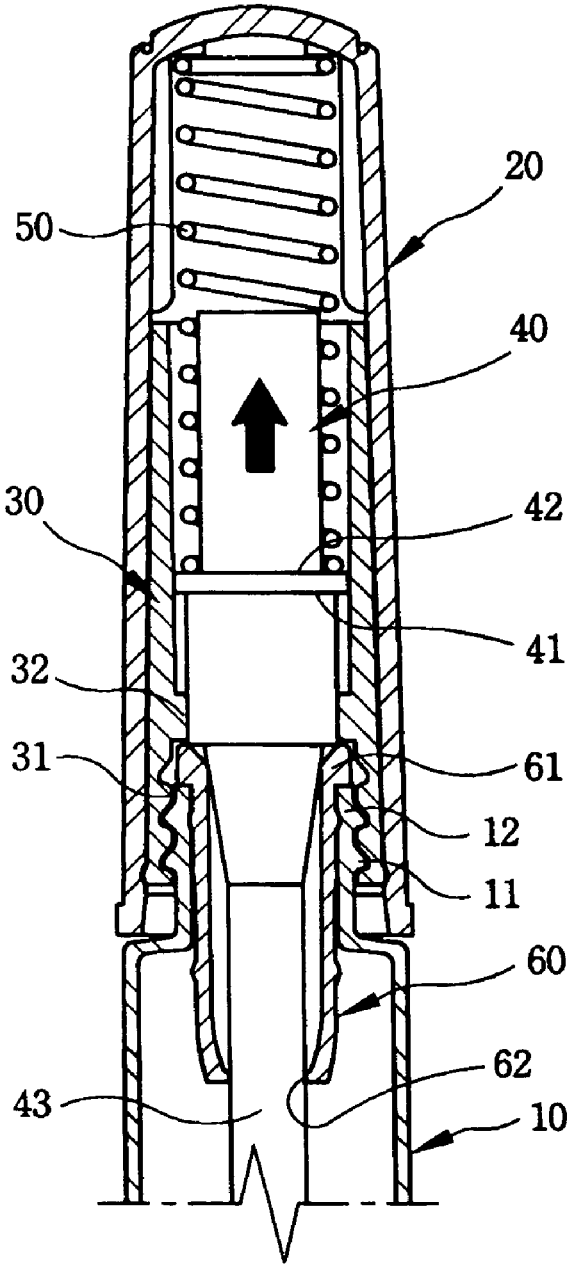
FIG. 4 is a view to show an upward movement of a brush unit, when a cap is coupled to a case body according to the present invention, through a screw-type fastening method.

FIG. 4 shows the upward movement of the brush unit, when the cap is coupled to the case body according to the present invention, through the screw-type fastening method, and FIG.

5 shows the downward movement of the brush unit, when the cap is separated from the case body according to the present invention.

In the mascara case of this invention, the scraping unit 60 is coupled to the neck 12 of the case body 10, and then mascara is filled in the case body 10.

The brush unit 40 is inserted into the cylindrical inner cap 30 so that the locking step 41 of the brush unit 40 is stopped by the annular step 32 of the inner cap 30. Subsequently, the spring 50 is seated in the spring seat 42 provided on the upper surface of the locking step 41 of the brush unit 40.

In such a state, the outer cap 20 is assembled with the inner cap 30. At this time, the inner cap 30 is placed to be close to the ribs of the outer cap 20, and the inner cap 30 is coupled to the outer cap 20, through the snap locking method, by the annular projection of the inner cap 30 and the annular groove of the outer cap 20. Thus, an end of the spring 50 is supported by the spring seat 42 of the brush unit 40, while the other end of the spring 50 is supported by the inner surface of the top wall of the outer cap 20.

When the cap is coupled to the case body 10 according to the present invention, the upward movement of the brush unit 40 will be described with reference to FIG. 4. That is, when the external threaded part 11 of the neck 12 of the case body 10 completely engages with the internal threaded part 31 of the inner cap 30, a predetermined portion of the brush unit 40 is restrained by the upper end of the scraping unit 60, and the brush unit 40 is biased upward by a predetermined distance.

At this time, the locking step 41 of the brush unit 40 moves away from the annular step 32 of the inner cap 30 by a predetermined distance. Further, the spring 50 supported, at both ends thereof, by the spring seat 42 of the brush unit 40 and the inner surface of the top wall of the outer cap 20, is compressed by a upward moving distance of the brush unit 40, thus retaining an elastic force. Simultaneously, the lower end of the brush 44 coupled to the lower end of the brush stem 43 of the brush unit 40 is placed to be close to the bottom of the case body 10.

Figure 5:
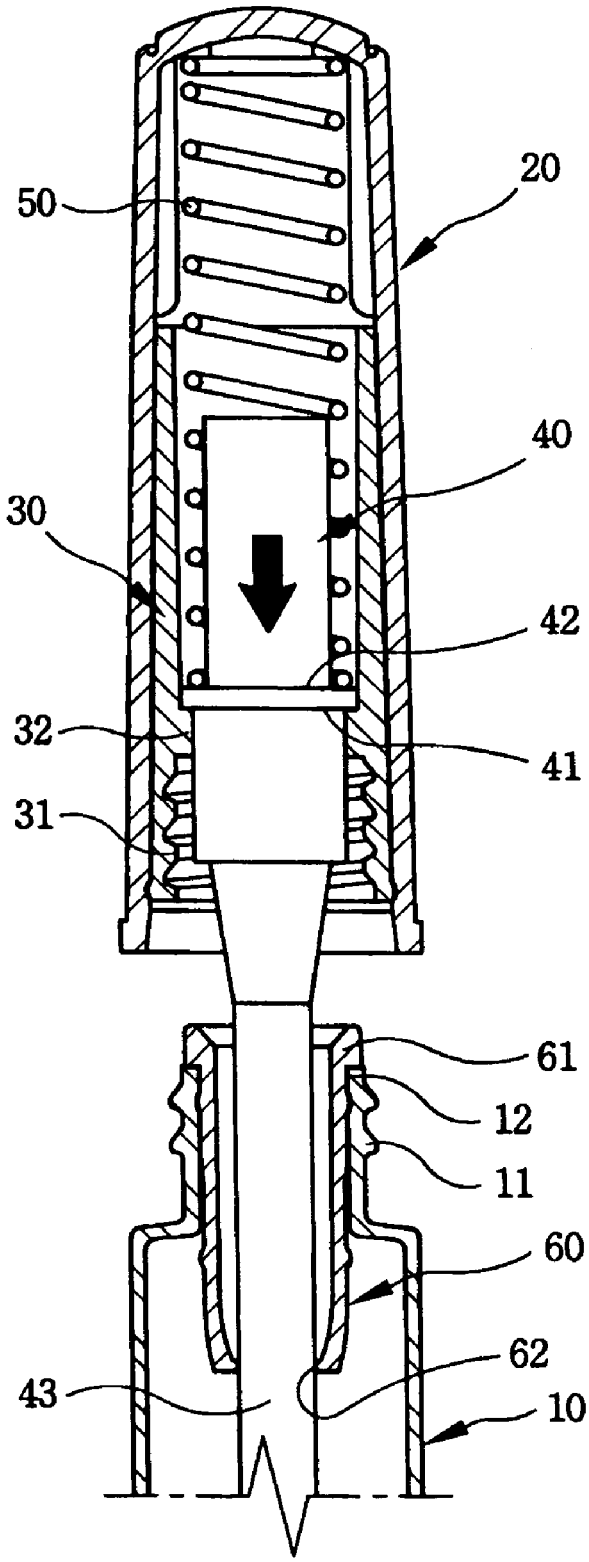
FIG. 5 is a view to show an downward movement of the brush unit, when the cap is separated from the case body according to the present invention.

Meanwhile, when the cap is separated from the case body 10, the downward movement of the brush unit 40 will be described with reference to FIG. 5. That is, when the cap is separated from the case body 10, the brush unit 40 is released from the scraping unit 60. Thus, the brush unit 40 moves downward by the elastic force of the spring 50. Such a downward movement of the brush unit 40 is carried out until the locking step 41 provided on the outer circumferential surface of the brush unit 40 is stopped by the annular step 32 of the inner cap 30.

That is, as the brush unit 40 moves downward by a predetermined distance, the brush stem 43 and the brush 44 coupled to the lower end of the brush stem 43 move downward, thus having an effect of increasing the length of the brush stem 43, and thereby, allowing the lower end of the brush 44 to approach the bottom of the case body 10, without completely coupling the cap to the case body 10 through the screw-type fastening method.

As a result, it is possible to easily use a small amount of mascara without completely closing the cap.

INDUSTRIAL APPLICABILITY

As described above, the present invention provides a case with a spring-loaded mascara brush, which is constructed so that a brush stem is provided along a central axis of a cap which opens or closes a case body, in such a way as to move vertically. Therefore, when the cap is opened, the brush stem moves downward by a predetermined distance, thus allowing a user to easily use a small amount of mascara remaining in a bottom of the case body without the necessity of closing the cap. Further, when the cap is coupled to the case body to close the case body, the brush stem coupled to the cap moves upward, thus preventing the brush from touching the bottom of the case body. Therefore, convenience is achieved, in addition to reducing waste of mascara.

Further, the present invention provides a case with a spring-loaded mascara brush, which has a scraping unit coupled to an inner circumferential surface of a neck of a case body to extend downward, thus scraping off surplus mascara covered on a brush or brush stem, therefore simply and efficiently preventing the loss of mascara.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A case with a spring-loaded mascara brush, comprising a case body to contain a predetermined amount of mascara therein, with a neck being provided at an upper end of the case body and having an external threaded part, an outer cap to cover an upper portion of the case body, a brush unit provided in the outer cap, with a brush stem integrally provided at a lower portion of the brush unit to extend to a predetermined length, and a brush coupled to a lower end of the brush stem, the case further comprising:

an inner cap having a shape of a hollow cylinder which is opened at top and bottom ends thereof, and fastened to an interior of the outer cap through a force-fit method, the inner cap comprising:

an internal threaded part provided on an inner circumferential surface of a lower portion of the inner cap to correspond to the external threaded part of the neck; and an annular step integrally projecting from the inner circumferential surface of the inner cap at a position above the internal threaded part;

the brush unit inserted into the inner cap to move vertically by a predetermined distance, and comprising:

an annular locking step provided at a predetermined position on an outer circumferential surface of the brush unit to be stopped by the annular step of the inner cap;

a spring seat provided on an upper surface of the annular locking step to be depressed; and the brush stem integrally provided at the lower portion of the brush unit to extend to the predetermined length, thus being inserted into the case body; and a spring supported, at both ends thereof, by the spring seat and an inner surface of the outer cap, thus elastically biasing the brush unit during a vertical movement of the brush unit, and thereby, moving the brush stem in a vertical direction.

2. The case according to claim 1, further comprising:

a scraping unit coupled to the neck of the case body, and having a shape of a hollow cylinder which is opened at top and bottom ends thereof, the scraping unit comprising:

a locking ring provided around an outer circumference of an upper end of the scraping unit; and a protrusion provided around an inner circumference of a lower end of the scraping unit to scrape off surplus mascara covered on the brush.

* * * * *